US006722084B2

(12) United States Patent
Berman

(10) Patent No.: US 6,722,084 B2
(45) Date of Patent: Apr. 20, 2004

(54) INFLATABLE TENT

(75) Inventor: Stephen Berman, Malibu, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 81 days.

(21) Appl. No.: 10/134,248

(22) Filed: Apr. 26, 2002

(65) Prior Publication Data

US 2002/0162584 A1 Nov. 7, 2002

Related U.S. Application Data

(60) Provisional application No. 60/287,953, filed on May 1, 2001.

(51) Int. Cl.[7] ..... E04H 15/02; E04B 1/34

(52) U.S. Cl. ..... 52/2.11; 52/2.17; 52/2.18; 446/220; 135/87; 135/96; 135/120.1

(58) Field of Search ..... 52/2.11, 2.17, 52/2.18; 446/220

(56) References Cited

U.S. PATENT DOCUMENTS

| | | | | |
|---|---|---|---|---|
| 3,068,494 | A | * | 12/1962 | Pinkwater |
| D216,352 | S | | 12/1969 | Martin et al. |
| 4,031,674 | A | | 6/1977 | Rand |
| 4,171,595 | A | * | 10/1979 | Tucker |
| 4,332,112 | A | * | 6/1982 | Hsu |
| 4,556,391 | A | * | 12/1985 | Tardivel et al. |
| 4,781,413 | A | * | 11/1988 | Shumack |
| D300,649 | S | | 4/1989 | Tauer |
| 4,858,635 | A | | 8/1989 | Eppenbach |
| 4,901,481 | A | | 2/1990 | Seeley, Jr. |
| D326,495 | S | | 5/1992 | Pearce |
| D361,364 | S | | 8/1995 | Winters |
| 5,570,544 | A | * | 11/1996 | Hale et al. |
| 5,632,055 | A | * | 5/1997 | Graf |
| 5,678,357 | A | * | 10/1997 | Rubio et al. |
| D396,087 | S | | 7/1998 | Liu |
| 5,890,338 | A | * | 4/1999 | Rodriguez-Ferre |
| 5,893,238 | A | | 4/1999 | Peacock et al. |
| 5,930,854 | A | * | 8/1999 | O'Neill et al. |
| 5,970,661 | A | | 10/1999 | Bishop et al. |
| 6,053,792 | A | * | 4/2000 | Sallee et al. |
| 6,065,253 | A | * | 5/2000 | Ojeda |
| 6,192,633 | B1 | | 2/2001 | Hilbert |
| D439,946 | S | | 4/2001 | Gourchounian |
| 6,560,095 | B1 | * | 5/2003 | Zheng |
| 6,565,405 | B2 | * | 5/2003 | Hsu et al. |
| 2001/0038522 | A1 | * | 11/2001 | Zheng |

FOREIGN PATENT DOCUMENTS

| | | | | |
|---|---|---|---|---|
| EP | 1 151 760 | * | 11/2001 | ..... A63B/9/00 |

* cited by examiner

*Primary Examiner*—Robert Canfield
(74) *Attorney, Agent, or Firm*—Katten Muchin Zavis Rosenman

(57) ABSTRACT

A tent is provided with an inflatable support structure having a manually operated inflation pump associated with the inflatable support structure and the tent. The pump is fixedly attached to the tent such that the tent and the pump form a single, integrated unit. The pump is preferably movable between a storage position and a use position. While in the storage position, the pump is also preferably is hidden or camouflaged by the tent environment. The tent structure may also be enhanced with sound capabilities for increasing enjoyment and use of the tent.

22 Claims, 2 Drawing Sheets

INFLATABLE TENT

CROSS REFERENCE TO RELATED APPLICATIONS

This application claims the benefit under 35 U.S.C. §119 (e) from provisional application 60/287,953 filed May 1, 2001.

FIELD OF THE INVENTION

This invention relates to inflatable structures generally, and more specifically to an inflatable tent structure having an integrally attached inflation pump.

BACKGROUND OF THE INVENTION

Inflatable tents and other inflatable enclosures are known. A simple example is shown in U.S. Des. Pat. 396,087 to Liu.

Certain inflatable houses have an inflatable support structure and an inflatable interior chamber. U.S. Pat. Nos. 5,970,661 to Bishop et al. and 4,031,674 to Rand are illustrative of such structures. Other structures have inflatable support members only, and do not have an air pressurized interior chamber. U.S. Des. Pat. 216,352 to Martin et al. illustrates one such structure.

In all cases, however, inflatable tent structures either require the connection of a separate inflation means, or are dependent upon the use of a separate power source. For example, both the Rand '674 and the Bishop et al. '661 structures require a connection to an electric power source to operate the inflation fan. Another example is shown in U.S. Pat. No. 6,192,633 to Hilbert, wherein a separate compressed air tank must be connected to a manifold to inflate the support structure. Similarly, in U.S. Des. Pat. 361,364 to Winters, a nozzle is provided for connection to either a separate inflation pump or for engagement by a person's mouth depending on the size of the inflatable structure. Other conventional inflatable structures such as beach balls, pool floats, travel pillows and the like are all provided with a nozzle or the like for attachment to a separate inflation means.

For portable, transportable inflatable structures that are dependent on ancillary inflation means, whether such means is an electrical pump or a foot-operated bellows-type pump, such inflation means may limit and restrict the ability to use such structures in any desired environment. For example, it would be impossible to use an inflatable tent in the back woods if such tent requires the use of an electrical inflation pump. Similarly, it may be inconvenient to have to bring a mechanical type inflation pump along with the inflatable housing structure particularly if the inflation pump is being used for other items.

Thus, there is a need to provide an inflatable structure that is not dependent on ancillary inflation means and that does not require a user to blow into an air nozzle. Such need is met by the inflation apparatus of the present invention having an integrated inflation means that expedites inflation, is quick and easy to operate, and does not require a connection to an outside power source. The inflatable tent of the present invention is easily transportable and can be used in any environment without concern for supplementary energy sources and without requiring the user to exhaust lung capacity.

SUMMARY OF THE INVENTION

A tent or the like having an inflatable support structure comprises a manually operated inflation pump associated with the inflatable support structure and the tent or the like. The pump is fixedly attached to the tent such that the tent and the pump form a single, integrated unit. The pump is preferably movable between a storage position and a use position. While in the storage position, the pump is also preferably is hidden or camouflaged by the tent environment. In addition, the tent structure may be enhanced with sound means or other means for increasing enjoyment and use of the tent.

DETAILED DESCRIPTION OF THE PREFERRED EMBODIMENTS

Figure 1:
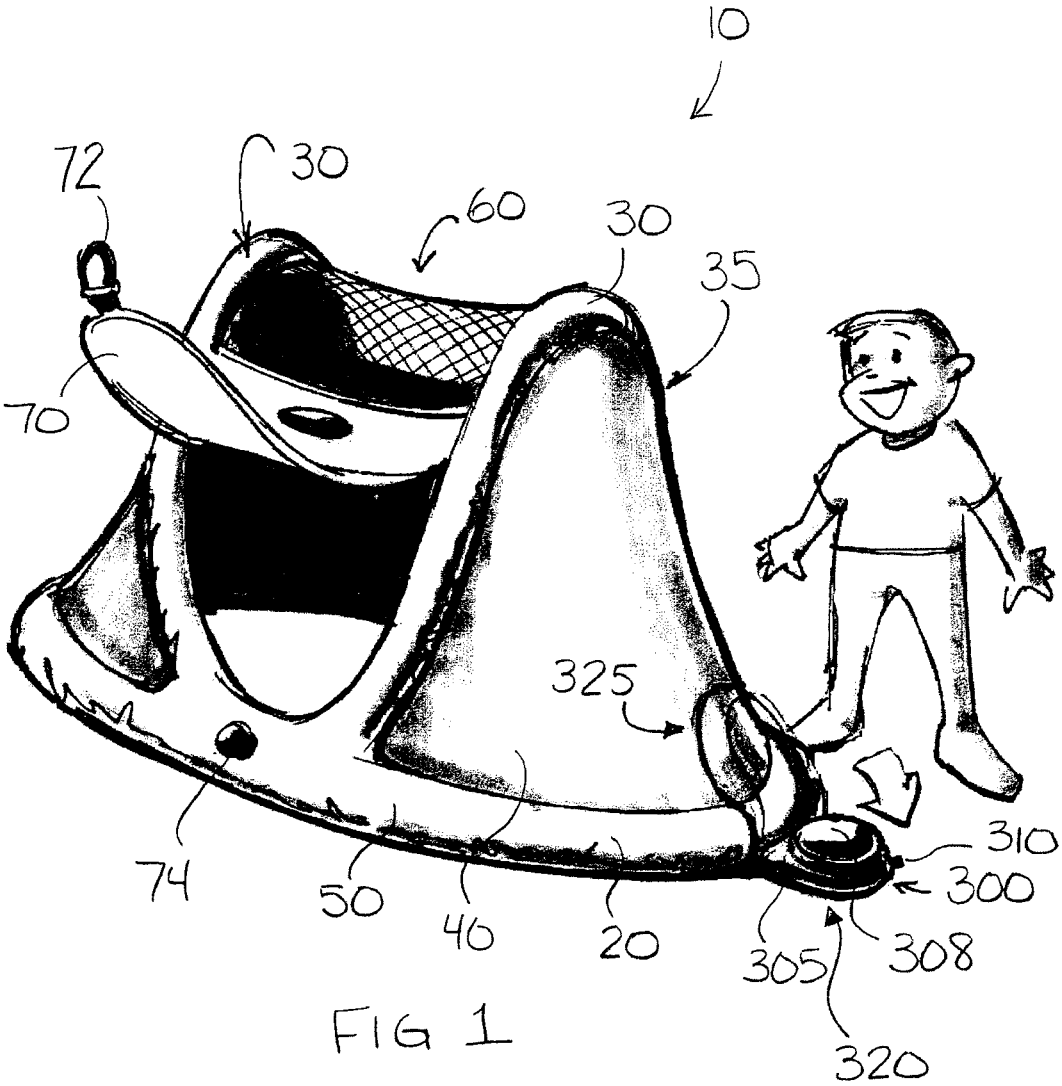
FIG. 1 illustrates the inflatable structure of the invention as a camping tent.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Figure 2:
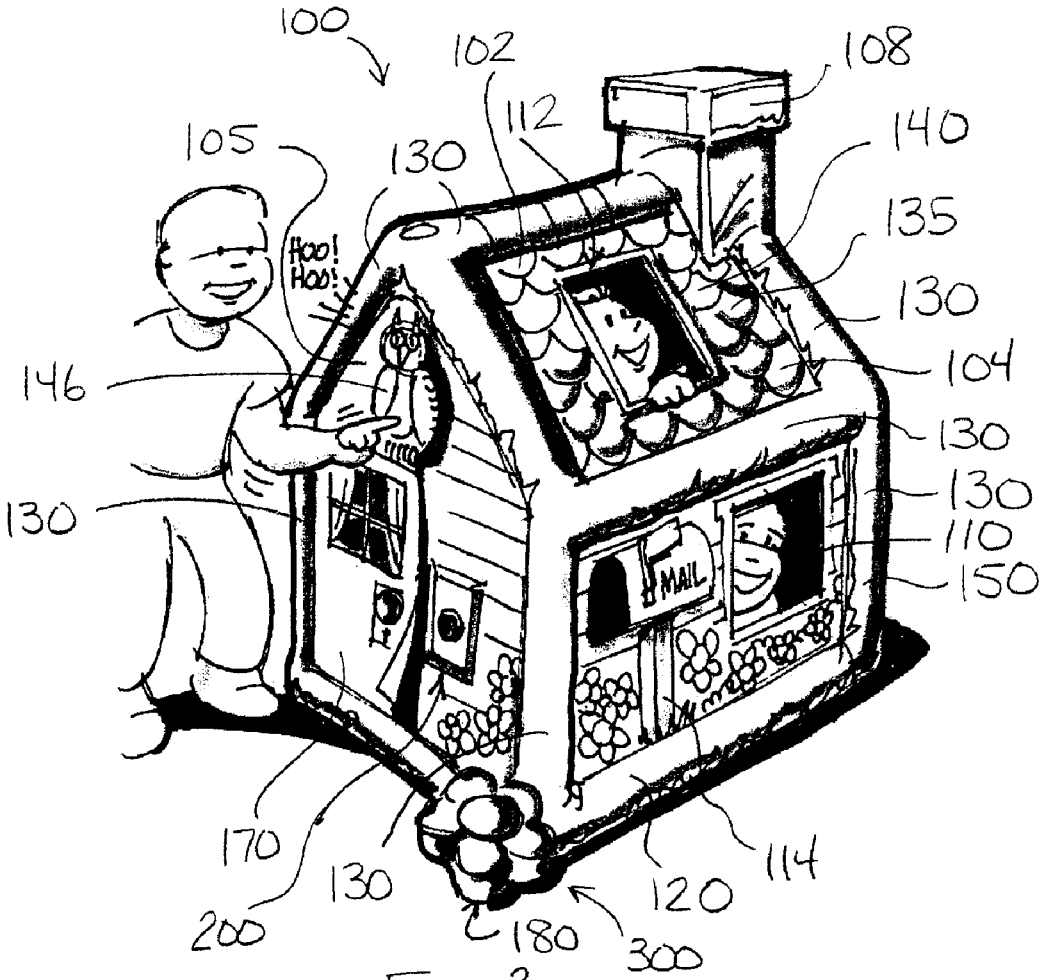
FIG. 2 illustrates the inflatable structure of the invention as a playhouse.

FIG. 1 illustrates an inflatable tent 10 of the present invention. The term "tent" as used herein is not intended to be construed in a limiting fashion, such that only actual "camping tents" or the like are contemplated. For instance, the inflatable tent 10 of the present invention may be in the form of a camping tent as shown in FIG. 1, or a house as shown in FIG. 2, or any structural design suitable for use as an inflatable structure. In addition, while most of the illustrations of the present invention relate to play enclosures, it is not intended that the application be limited to enclosed structures or structures suitable for children. For purposes of illustration and explanation, however, the inflatable structure of the present invention will be illustrated as a camping tent or a child's play house as shown in FIGS. 1 and 2.

The inflatable tent 10 of FIG. 1 comprises an inflatable base 20, suitable for positioning on a support surface, and a plurality of inflatable walls 30. Similarly, the inflatable tent 100 of FIG. 2 comprises an inflatable base 120 and a plurality of inflatable walls 130. While the tents are illustrated with two or more walls 30, 130, it will be understood that any number of walls will be operable as long as the tent is inflated for its desired purpose. The base 20, 120 and walls 30, 130 define an inflatable support structure formed by a network of interconnected inflation passages. When inflated, the inflatable support structure preferably enables the tent to form a freestanding enclosure, with suitable material 35, 135 spanning between the walls 30, 130 and base 20, 120 to further define such enclosure.

More specifically, the inflatable support structure of the present invention is preferably constructed with a combination of single layered and double layered, heat-sealed PVC (polyvinylchloride) portions 40, 140 and 50, 150 respectively. Materials having other chemical compositions are clearly contemplated. The single-layered portions 40, 140 preferably form the wall material 35, 135, while the double-layered portions 50, 150 preferably form the base 20, 120 and wall chambers 30, 130. In some instances mesh or nylon fabric inserts 60 could replace the single layered PVC portions 40. The double-layered, heat-sealed portions or bladders, when filled with an inflation fluid such as air, create structural chambers that are strategically positioned to define and give structural form, creating a three-dimensional structure.

The tent of the present invention is provided with inflation means 300 integrally associated with the network of interconnected inflation passages. Such inflation means 300 is preferably constructed as a manually operated foot pump 305 (FIG. 1) integrally associated with the inflatable base 20 of the tent structure that serves to inflate and deflate the inflatable support structure of the tent. The pump 305 is activated by an application of force upon the pump upper surface 308, which causes a compression of the pump interior (not shown) that results in the introduction of an inflation fluid such as air into the inflatable support structure. Repeated compressions of such pump results in the dispersion of fluid throughout the network of interconnected inflatable chambers until the tent structure is fully inflated. A switch 310 or the like provided on the pump enables a user to change the pump from an inflation mode to a deflation mode, wherein the airflow direction may be controlled as desired. While such means 300 is preferably connected directly to the inflatable structural support members, such means 300 may also service the interior of the tent structure if desired.

The inflation means 300 is integrated into the design of the tent and is preferably non-removable. Such means 300 is also preferably hingedly movable between a use position 320, wherein the pump surface 308 is easily accessible to the foot of user for inflation and deflation, and a storage position 325, wherein the pump surface 308 is disposed adjacent a wall of the tent structure and secured in such position by suitable securing means. Integrating the inflation means into the design of the tent is also preferable so that the inflation means housing does not appear to be an obvious feature of the overall tent appearance. For example, the pump 180 (FIG. 2) associated with the inflatable base 120 may take the form of a flower attached to the house 100, so that the pump 180 appears camouflaged into the design of the house 100. Pump 180 is operated in a similar manner to pump 305.

While the inflation means of the present invention is illustrates as a foot-operated pump, it will be appreciated that such pump may be located in a position that is suitable for access by another part of a user's body. It will also be appreciated that other types of pumps that do not rely on the compression of a bladder will be operable. While it is preferable that the pump is integrally associated with the tent housing, it is not necessary that the pump is located directly adjacent the tent as shown. Furthermore, it is preferable that the inflation means is not dependent on alternative energy sources such as that provided by an electrical connection and/or such as that which would restrict use of the tent in a particular environment.

Figure 3:
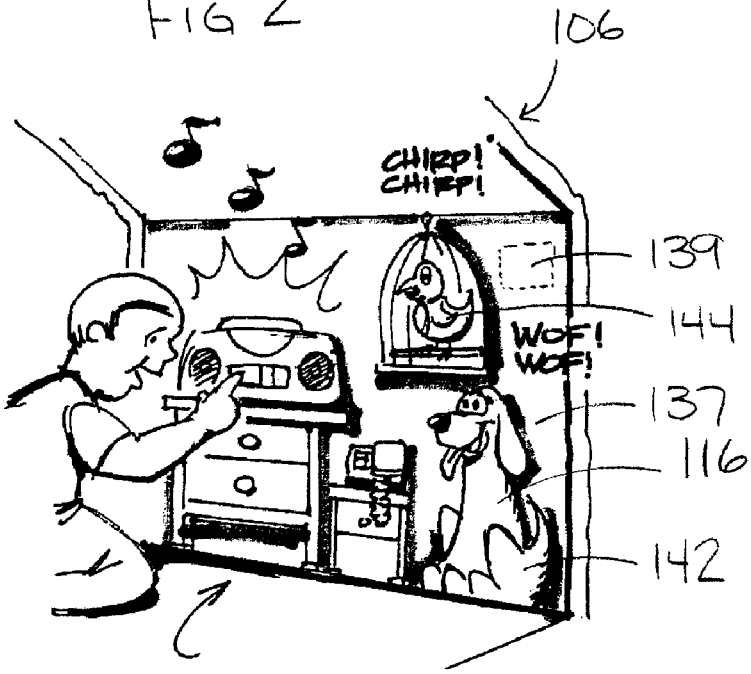
FIG. 3 illustrates one embodiment of the inside of the playhouse of FIG. 2.

The inflatable structure of the present invention may also be adorned with visual images indicative of the particular design of the structure. For example, if the inflatable structure is in the shape of a house 100 as shown in FIG. 2, such house 100 might have siding 102, shingles 104 on the roof 106, a chimney 108, windows 110, a sunroof 112, a mailbox 114 and the like, all of which are indicative of a house-type dwelling. Other images are clearly contemplated. As shown in FIG. 3, the inside of the structure 100 might also have images and designs 116 printed on the interior walls 137. Similarly, a camping tent inflatable structure 10 as shown in FIG. 1 might have camping tent features, such as a mesh roof and the like.

The inflatable structures 10, 100 of the present invention may further comprise doors 70 (FIG. 1), 170 (FIG. 2) that may have a variety of closure means. One example is illustrated in FIG. 1, wherein a simple loop-type closure 72 associated with the door 70 is strappable around a peg 74 provided on the tent body. Another example is illustrated in FIG. 2, wherein the door 170 is connected to the house 100 by a zipper closure, a Velcro® closure or something akin to a Ziploc® closure. Other closure means are clearly contemplated. Such closure means may be associated with any part of the inflatable structure that is capable of opening and closing, such as a door, window or the like.

The inflatable structure of the present invention may also comprise features designed to enhance the use and enjoyment of the structure. One example of such a feature includes the incorporation of sound means 200 into the walls of the structure. Such sound means 200 may be touch-activated, battery-operated inserts, in which case they may be serviced or replaced at some time in the future, or they may be integrally formed into the walls of the structure. In other words, accessible pockets 139 may be provided in the walls of the structure to house the sound means or the like, or such means may be integrally formed between layers of wall material at the time of manufacture. Such sound means may be operable by a button or switch, which button or switch may be indicative of the nature of the sound. For instance, a "WOF WOF" sound will be heard by touching an image 142 of a dog on an interior wall 137 of the house 100 of FIG. 3. Similarly, a "CHIRP CHIRP" sound will be heard by touching an image 144 of a bird on an interior wall 137 of the house 100. Similarly, a "HOO HOO" sound will be heard by touching an image 146 of an owl on an exterior wall 105 of the house 100 of FIG. 2. Such sound means may be located throughout the structure as shown. Other use-enhancing features may be incorporated into the design of the tent as desired. Such features are not intended to be restricted to audio generators, but could also include means for generating effects that access the normal human senses of touch, taste, feel, sight and smell.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. An inflatable tent comprising:

a) an inflatable support structure defining an enclosure when inflated, and b) an inflation pump integrally attached to said inflatable support structure for inflating said inflatable support structure, c) sand inflation pump being operated solely by human-powered mechanical means, d) wherein said inflation pump is movable from a storage position to a use position, and e) wherein said inflation pump is irremovable.

2. An inflatable tent in accordance with claim 1, wherein said inflatable support structure further comprises an inflatable base and an inflatable wall structure connected to said inflatable base, and said inflation pump is integrally associated with said inflatable base.

3. An inflatable tent in accordance with claim 1, wherein said inflation pump has an inflation mode and a deflation mode and means for switching between said inflation and deflation modes.

4. An inflatable tent in accordance with claim 1, wherein said inflation pump further comprises means for deflating said inflatable support structure.

5. An inflatable tent in accordance with claim 1, further comprising a control means for causing said inflation pump to inflate or deflate said inflatable support structure.

6. An inflatable tent in accordance with claim 1, wherein said inflation pump operates by compression.

7. An inflatable tent in accordance with claim 1, wherein said inflatable support structure further comprises an inflatable base, an inflatable wall structure connected to said inflatable base and wall material extending between said inflatable wall structure and said inflatable base.

8. An inflatable tent in accordance with claim 1, further comprising sound means incorporated into said inflatable structure.

9. An inflatable tent in accordance with claim 8, wherein said inflatable support structure further comprises an inflatable base, an inflatable wall structure connected to said inflatable base and wall material extending between said inflatable wall structure and said inflatable base and wherein said sound means is disposed in a pocket in said wall material.

10. An inflatable tent in accordance with claim 9, wherein said sound means is removable from said pocket.

11. An inflatable tent comprising:

a) an inflatable support structure defining an enclosure when inflated, and b) an inflation pump integrally attached to said inflatable support structure for inflating said inflatable support structure, c) said inflation pump being operated solely by human-powered mechanical means, and d) wherein said inflation pump is foldable from a storage position to a use position.

12. An inflatable tent in accordance with claim 11, wherein said inflation pump is irremovable.

13. An inflatable tent comprising:

a) an inflatable support structure defining an enclosure when inflated, and b) an inflation pump integrally attached to said inflatable support structure and extendable outwardly therefrom for inflating said inflatable support structure, c) wherein said inflatable lent has an aesthetic appearance and said inflation pump is camouflaged by said appearance such that said inflation pump is nor recognized to be an inflation pump but instead appears like part of an environment of the inflatable tent.

14. An inflatable tent in accordance with claim 13, wherein said inflation pump is movable from a storage position to a use position.

15. An inflatable tent in accordance with claim 13, wherein said aesthetic appearance is in the form of a house and said inflation pump is in the form of a flower attached to the house.

16. An inflatable tent comprising:

a) an inflatable base adapted for resting on a support surface, b) an inflatable wall connected to said inflatable base, c) fabric extending between said inflatable wall structure and said inflatable base such that said inflatable base, said inflatable wall structure and said fabric define an enclosure when said inflatable base and wall are inflated, d) sound means integrated into said fabric, and e) an inflation pump attached to said inflatable tent and foldable relative to said inflatable base from a storage position to a use position.

17. An inflatable tent in accordance with claim 16, wherein said sound means are touch operated.

18. An inflatable tent in accordance with claim 16, wherein said sound means are removable from said fabric.

19. An inflatable tent in accordance with claim 17, wherein said fabric further comprises images associated with said sound means.

20. An inflatable tent in accordance with claim 16, wherein said fabric further comprises an image associated with said sound means.

21. An inflatable tent in accordance with claim 20, wherein sound from said sound means is representative of said image and is generated upon the application of a force upon said image.

22. An inflatable tent in accordance with claim 21, further comprising multiple images and multiple sound means associated therewith.

* * * * *